US012168926B2

(12) United States Patent
Hered

(10) Patent No.: US 12,168,926 B2
(45) Date of Patent: Dec. 17, 2024

(54) SYSTEMS AND METHODS FOR DETERMINING HIGH-SPEED ROTATING TOOLFACE WITHIN A WELL

(71) Applicant: Baker Hughes Oilfield Operations LLC, Houston, TX (US)

(72) Inventor: William A. Hered, Houston, TX (US)

(73) Assignee: Baker Hughes Oilfield Operations LLC, Houston, TX (US)

( * ) Notice: Subject to any disclaimer, the term of this patent is extended or adjusted under 35 U.S.C. 154(b) by 0 days.

(21) Appl. No.: 17/901,925

(22) Filed: Sep. 2, 2022

(65) Prior Publication Data

US 2024/0084694 A1 Mar. 14, 2024

(51) Int. Cl.
*E21B 47/024* (2006.01)
*E21B 47/002* (2012.01)

(52) U.S. Cl.
CPC ..... *E21B 47/024* (2013.01); *E21B 47/0025* (2020.05)

(58) Field of Classification Search
CPC .... E21B 47/024; E21B 47/0025; E21B 47/00; E21B 2200/20; G01V 3/38; G01V 3/081
See application file for complete search history.

(56) References Cited

U.S. PATENT DOCUMENTS 6,443,242 B1 * 9/2002 Newman et al.
9,581,718 B2 * 2/2017 Rodney ..... E21B 47/0228
10,641,077 B2 * 5/2020 Sullivan et al.
11,299,981 B2 * 4/2022 Nguyen et al.
2002/0133958 A1 9/2002 Noureldin et al.
2007/0234580 A1 10/2007 Ekseth et al.
2010/0187008 A1 * 7/2010 Wassermann et al.
2014/0368200 A1 * 6/2014 Wang et al.
2018/0045850 A1 2/2018 Smidth et al.
2018/0180418 A1 6/2018 Estes et al.
2021/0293129 A1 9/2021 Panchal et al.
2021/0396128 A1 * 12/2021 Wisinger

OTHER PUBLICATIONS

S. Sabatelli, M. Galgani, L. Fanucci and A. Rocchi, "A double stage Kalman filter for sensor fusion and orientation tracking in 9D IMU," 2012 IEEE Sensors Applications Symposium Proceedings, Brescia, Italy, 2012, pp. 1-5, doi: 10.1109/SAS.2012.6166315. (Year: 2012).*
International Search Report issued by the Korean Intellectual Property Office as the International Searching Authority (KIPO/ISA) for PCT Application No. PCT/US2023/073476, mailed Jan. 9, 2024, 10 pages.

* cited by examiner

*Primary Examiner* — Tara Schimpf
*Assistant Examiner* — Ursula Lee Norris
(74) *Attorney, Agent, or Firm* — Baker Hughes Company

(57) ABSTRACT

Systems and methods for determining the orientation of the toolface of a rotating downhole tool using multiple sensors that measure different parameters related to the orientation of the toolface, where outputs of the different sensors are used by a Kalman filter which generates accurate predictions of the toolface orientation (state) at each of a series of time steps. The Kalman filter generates a state prediction based on a physical model and a previous state, and updates the prediction based on a received sensor output. Another sensor output is fed through a phase locked loop to generate a sine wave at the fundamental frequency of the sensor signal. The sine wave is used to synchronize another sensor signal that is provided to the Kalman filter for further adjustment of the state prediction.

13 Claims, 3 Drawing Sheets

SYSTEMS AND METHODS FOR DETERMINING HIGH-SPEED ROTATING TOOLFACE WITHIN A WELL

BACKGROUND

Field of the Invention

The invention relates generally to downhole oilfield operations, and more particularly to systems and methods for using parameters measured with respect to a rotating downhole tool to accurately determine a toolface corresponding to measurements made by the downhole tool.

Related Art

Rotating downhole tools are sometimes used to make measurements of particular parameters with respect to the borehole of a well. For instance, the tool may use an ultrasonic sensor to measure casing and cement conditions. The tools are rotated to scan around the borehole, thereby taking measurements of the parameter at a series of azimuthal angles around the borehole. The measurements may be of the interior surface of the wellbore, or they may be penetrating measurements of conditions beyond the surface of the borehole.

In addition to making measurements of the particular parameter around the borehole, the tool associates each measurement of the particular parameter with a corresponding position in the borehole. The position typically has an axial component (the depth within the borehole) and a rotational component (the angular position of the measurement sensor as the portion of the tool containing the sensor rotates within the borehole). The depth of the tool and sensor is determined by tracking the length of pipe, wireline, etc. supporting the tool as it is lowered into the borehole.

Because the axial and rotational position information is associated with the measured parameter information, an "image" of the measured parameter can be constructed. For the purposes of this disclosure, an "image" may be any reconstruction of measured data using the associated position information. The image may actually be a photographic image, or it may be a mapping of any given measured parameter as a function of position within the borehole.

Historically, these measurements have been obtained using a tool connected to a wireline that is lowered into the borehole. The tool has a first component that is connected to the wireline and maintains a relatively stationary orientation in the borehole. A second component of the tool carries the sensor that measures the desired parameter rotates with respect to the first component so that it can scan the interior of the borehole. The direction this sensor is facing is referred to as the "toolface". In this type of tool, the position of the rotating component of the tool is known with respect to the non-rotating component of the tool, so the orientation of the rotating component and the toolface is known.

However, if the tool is connected to the end of a drill pipe and is rotated by rotation of the drill pipe, the tool cannot simply determine the toolface with respect to a non-rotating component because the entire tool is rotating. Additionally, because the drill pipe may be very long, it may be very flexible in the torsional direction (i.e., it may twist), so the toolface at the bottom of the drill pipe cannot be determined simply from the orientation of the upper end of the drill pipe.

With this type of tool connected to a drill pipe, it is necessary to use one or more sensors on the tool to provide information about the toolface. For example, the tool may incorporate accelerometers, gyroscopes, or magnetometers to help determine the toolface. These sensors, however, have their own shortcomings. For instance, accelerometers are affected by external vibrations, and or not useful in vertical wells because this eliminates the gravitational force from being used to determine the toolface. Gyroscope derived toolface has the problem of drifting over time. Magnetometers are useful in vertical wells, but they are difficult to use in cased wells because the metal of the casing interferes with the readings, and may actually have greater magnetization than the earth's magnetization.

Because of these problems it would be desirable to provide systems and methods for determining the toolface of rotating tools within cased wells.

SUMMARY

This disclosure is directed to systems and methods for determining the orientation of the toolface of a rotating downhole tool using multiple sensors that measure different parameters related to the orientation of the toolface. The outputs of the different sensors are used (some directly and others after being preprocessed) by a sensor fusion algorithm such as an extended Kalman filter or an unscented Kalman filter, which uses this information to generate accurate predictions of the toolface orientation at each of a series of time steps. The predicted toolface orientations and depth information at each time step is used to map a parameter measured from in the wellbore by the rotating tool.

One exemplary embodiment comprises a method for determining the orientation of a toolface of a rotating tool in a well. The method includes providing a measurement tool, positioning the tool in a wellbore, and rotating the tool in the wellbore. The measurement tool has a measurement sensor to measure a desired parameter and a plurality of rotational sensors adapted to measure corresponding parameters that are dependent upon a rotational orientation of the tool. For each of a series of time steps while the tool is rotating in the wellbore, the desired parameter is measured with the measurement sensor and the parameters corresponding to the plurality of rotational sensors are also measured. For each of the series of time steps, the measurements of the parameters corresponding to the plurality of rotational sensors are provided to a sensor fusion algorithm such as a Kalman filter which generates a prediction of a current toolface orientation based on a preceding toolface orientation and the measurements of the parameters corresponding to the plurality of rotational sensors. Data is generated to map the desired parameter, the data including for each of the series of time steps, the corresponding measurement of the desired parameter and the corresponding predicted toolface orientation.

The depth of the tool in the wellbore may also be measured for each of the series of time steps. The method may also include generating an image of the desired parameter as a function of position in the wellbore, the position comprising the depth of the tool in the wellbore and the toolface, as well as the desired parameter to be mapped.

In some embodiments, the tool is coupled to a drill pipe and the tool is rotated in the wellbore by rotating the drill pipe. In some embodiments, the rotational sensors include a gyroscope and a set of accelerometers, where measuring the parameters corresponding to the plurality of rotational sensors comprises measuring an angular velocity of the gyroscope and measuring an acceleration using the set of accelerometers. The rotational sensors may also include a magnetometer, where generating the prediction of the current toolface orientation further comprises providing an output of the magnetometer to a phase locked loop to generate a sine wave that is synchronized with the output of the magnetometer, and periodically updating the measurements from the second rotational sensor to synchronize the measurements from the second rotational sensor with the sine wave.

The Kalman filter may generate the prediction of the current toolface by generating an initial prediction based on the time step and a physics model for a change in the toolface between time steps; performing a first update of the initial prediction based on a corresponding measurement from a first rotational sensor of the plurality of rotational sensors to generate an intermediate prediction, and performing a second update of the intermediate prediction based on a corresponding measurement from a second rotational sensor of the plurality of rotational sensors to generate a final prediction.

An alternative embodiment comprises a system having a downhole measurement tool and a hardware processor. The downhole measurement tool includes a coupling adapted to connect the tool to a drill pipe, a measurement sensor adapted to measure a desired parameter radially outward from the downhole measurement tool in a direction of a toolface of the downhole measurement tool, and two or more rotational sensors adapted to measure corresponding parameters that are dependent upon a rotational orientation of the downhole measurement tool. The downhole measurement tool is adapted to be rotated within a wellbore. The rotational sensors may include a gyroscope and a set of accelerometers, as well as a magnetometer.

The hardware processor implements a Kalman filter that receives signals from the rotational sensors as inputs where, for each of a series of time steps, the downhole measurement tool rotates a corresponding amount, the measurement sensor makes a corresponding measurement, and the Kalman filter predicts a current toolface based on the toolface orientation for the preceding time step and the signals input from the rotational sensors. The hardware processor may also implement an imaging application which is adapted to map, for each time step, the corresponding measurement of the desired parameter as a function of the corresponding predicted toolface orientation and depth in the wellbore.

The Kalman filter may be adapted to generate each toolface prediction by generating an initial prediction based on the time step and a physics model for a change in the toolface between time steps, performing a first update of an initial prediction based on a corresponding measurement from a first rotational sensor of the two or more rotational sensors to generate an intermediate prediction, and performing a second update of the intermediate prediction based on a corresponding measurement from a second rotational sensor of the two or more rotational sensors to generate a final prediction. The output of the magnetometer may be provided to a phase locked loop to generate a sine wave that is synchronized with the fundamental frequency of the output of the magnetometer, where the measurements from the second rotational sensor are periodically updated to be synchronized with the sine wave.

In some embodiments, the hardware processor is installed on the tool and the Kalman filter processes the data generated from the measurement sensor(s) and rotational sensors while the tool is downhole. In some cases, the processing may be performed by the Kalman filter in real time. In other embodiments, the hardware processor may be implemented in equipment at the surface of the well, in which case the sensor data that is generated by the tool downhole is stored in a memory, and the data is retrieved from the memory and provided to the hardware processor for processing by the Kalman filter after the tool is retrieved from the well. The generation of data mapping the desired parameter as a function of toolface orientation and depth may also be performed either downhole in real time or after the tool is retrieved from the well.

Numerous other embodiments may also be possible.

The various embodiments of the invention may provide a number of advantages over existing systems. For example, since the orientation of the toolface can be accurately determined from the multiple rotational sensors, the entire tool can be rotated instead of using a tool that is designed for use with a wireline, where part of the tool remains stationary while another part rotates and the rotational position is determined from an encoder on the tool. This reduces the complexity and cost of the tool. The depth of the tool can also be more accurately determined since the tool is coupled to the end of a drill pipe, which is less flexible and elastic than a wireline. The use of information from multiple sensors also provides greater accuracy in determining the toolface orientation as compared to rotating tools that use only a single rotational sensor, and also allows the toolface orientation to be determined in environments in which single-rotational-sensor systems may be ineffective (e.g., a gyroscope derived position may drift over time, accelerometers do not work in vertical wells, magnetometers are not effective in cased wells). Still other advantages may be apparent to those skilled in the art.

BRIEF DESCRIPTION OF THE DRAWINGS

Other objects and advantages of the invention may become apparent upon reading the following detailed description and upon reference to the accompanying drawings.

Figure 1:
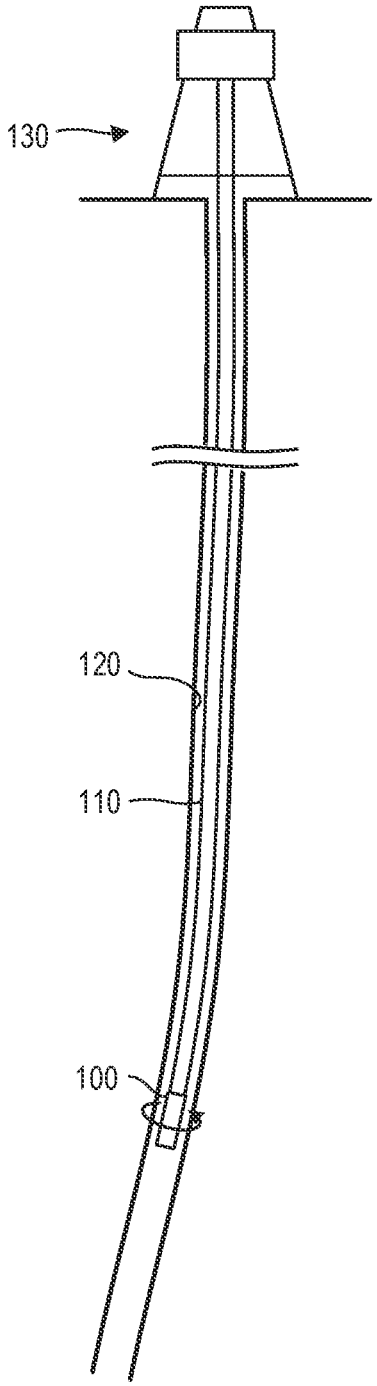
FIG. 1 is a diagram illustrating a system for imaging or mapping a measured parameter around a wellbore in accordance with some embodiments.

While the invention is subject to various modifications and alternative forms, specific embodiments thereof are shown by way of example in the drawings and the accompanying detailed description. It should be understood, however, that the drawings and detailed description are not intended to limit the invention to the particular embodiment which is described. This disclosure is instead intended to cover all modifications, equivalents and alternatives falling within the scope of the present invention as defined by the appended claims.

DETAILED DESCRIPTION OF EXEMPLARY EMBODIMENTS

One or more embodiments of the invention are described below. It should be noted that these and any other embodiments described below are exemplary and are intended to be illustrative of the invention rather than limiting.

Systems and methods disclosed herein are provided to resolve one or more of the problems described above. Generally, the present systems and methods involve taking measurements with a rotating tool coupled to the end of a drill pipe, the measurements including individual measurements of a first parameter which is to be mapped according to corresponding positions at the inner diameter of a wellbore. These measurements are taken at a series of successive time steps, and a position corresponding to each measurement is determined. As the tool is rotated, output values for two or more rotational sensors are recorded for the purpose of determining the toolface (rotational orientation) of the tool. The output values of the rotational sensors are provided as inputs to a Kalman filter which adjusts the computation of the toolface to provide a more accurate representation of the toolface.

It should be noted that "Rotational" sensors, as used herein, refers to sensors that are used to determine the toolface, rather than the sensor that measures the desired parameter at or beyond the wellbore's inner surface. Rotational sensors may include, for example, accelerometers, gyroscopes and magnetometers. The "measurement" sensor, on the other hand, is the sensor that measures the desired parameter of the wellbore, at its surface or penetrating deeper through the casing and cement into the surrounding formation. The sensors may be configured to make measurements that may include, but are not limited to gamma ray, formation resistivity, porosity, formation density and other types of measurements that are known by those skilled in the art and may be used for downhole evaluation of the casing, cement and formation properties.

When operation of the tool is commenced, a state of the tool is initialized to define the initial toolface. As the tool is operated, it rotates, and the toolface is predicted for each successive time step based on the state (toolface) for the previous time step and a physical model for the motion of the tool (e.g., rotation of the tool at a constant rate. the prediction of the toolface for each successive time step is updated based on the inputs from the rotational sensors (e.g., an accelerometer and a gyroscope). In some embodiments, these inputs themselves may be corrected using additional rotational sensor outputs (e.g., a magnetometer output may be processed with a PLL to generate a sine wave that can be used to correct the periodicity of the other sensor outputs).

Before describing exemplary embodiments in detail, it may be helpful to review the purpose and general operation of the tool. Referring to FIG. 1, a diagram is shown to illustrate a system for imaging or mapping a measured parameter of a wellbore. For the purposes of this disclosure, "imaging" and "mapping" are both used to refer to the process of measuring a parameter as a function of position. For example, a characteristic of the interior surface of a wellbore may be measured and recorded as a function of position on the wellbore surface, and this information can then be used to generate an actual 2D image of the wellbore surface.

Referring again to FIG. 1, a tool 100 is coupled to the lower end of a drill pipe 110, and the tool and drill pipe are lowered into well bore 120. The upper end of drill pipe 110 is coupled to surface equipment 130 which supports the drill pipe and tool. Surface equipment 130 is adapted to move drill pipe 110 and tool 100 axially within the well and to rotate the drill pipe and tool within the well. It should be noted that, in other embodiments, a downhole mud motor or other device may be used to rotate only a certain section of the drill pipe to which tool 100 may be connected.

For the purposes of this disclosure, "axially" refers to the direction parallel to the axis or centerline of the well. It should be noted that the well may not be straight, but may instead have various turns, so the axis/centerline is locally determined at the position of the tool. The direction of rotation of the tool likewise refers to the rotation around the local axis/centerline at the location of the tool.

Tool 100 has a measurement sensor (e.g., an ultrasonic, gamma ray, resistivity, porosity, density or other type of sensor) which is configured to make a measurement of the wellbore at a point which is radially outward from the axis of the tool. The "radial" direction is perpendicular to the axis of the tool. It should be noted, however, that in some embodiments, the measurement sensor may be configured to make a measurement at a point which is not, strictly speaking, radially outward from the sensor.

Figure 2:
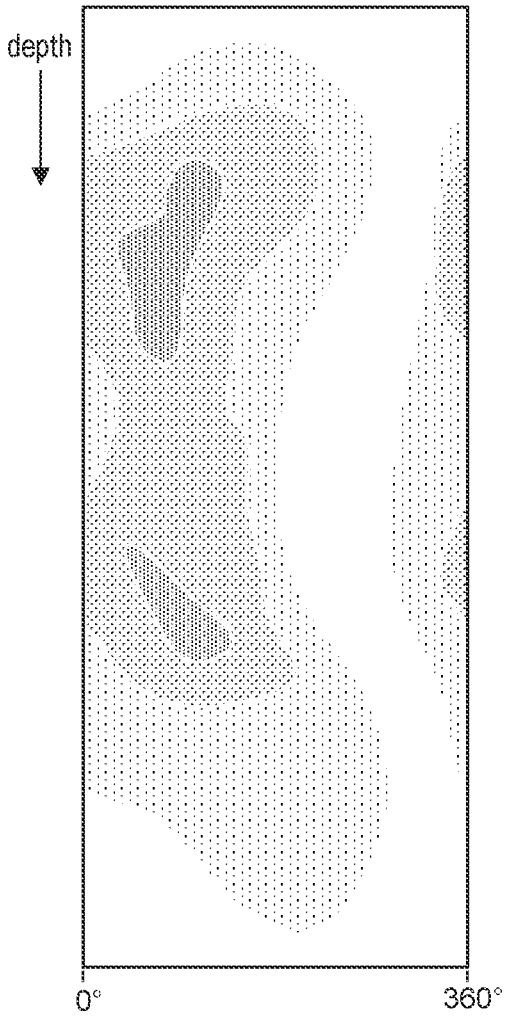
FIG. 2 is a diagram illustrating an image or map of a desired parameter as a function of azimuthal position in the wellbore in accordance with some embodiments.

In operation, surface equipment 130 rotates drill pipe 110, which in turn rotates tool 100. This causes the measurement sensor to scan around the wellbore so that, at successive time steps, the sensor takes measurements of the wellbore circumferentially around the wellbore. As noted above, these may be surface or penetrating measurements. Normally, as these measurements are taken, the tool is slowly raised or lowered within the well, so that the successive measurement points around the wellbore form a helix. The measurement points may be converted to a 2D image by representing the toolface direction (from 0 degrees to 360 degrees) as the X axis of the image and the axial direction as the Y axis of the image. This is equivalent to taking the generally cylindrical wellbore surface, splitting it on one side, and laying the surface flat. This is illustrated in FIG. 2.

As explained above, a conventional imaging system in which the entire imaging tool is rotating normally relies on a single rotational sensor to estimate the toolface at each time step, but each of the types of sensors that are used for this purpose has drawbacks that reduce the accuracy of the toolface estimation. The embodiments disclosed herein use the information generated by multiple rotational sensors to improve the accuracy of the estimated toolface and the accuracy of the 2D representation of the data obtained by the measurement sensor.

Figure 3:
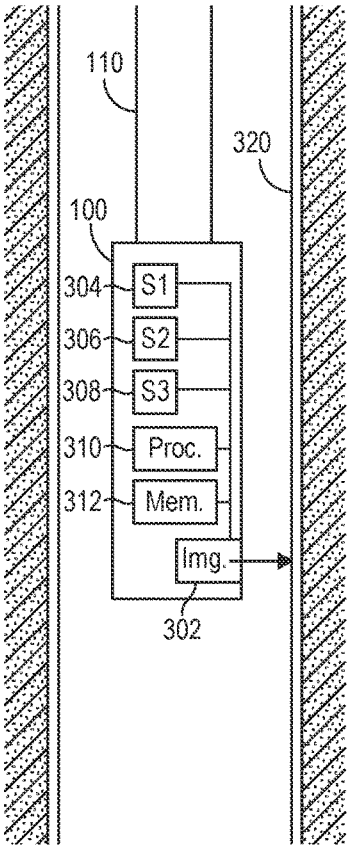
FIG. 3 is a diagram illustrating the components of an imaging system using multiple sensors input to a Kalman filter to determine toolface orientation in accordance with some embodiments.

Referring to FIG. 3, a diagram illustrating the components of the imaging system in accordance with some embodiments is shown. Tool 100 includes an imaging or measurement sensor 302 that is configured to measure the desired parameter of the wellbore (e.g., the inner surface of casing 320). Measurement sensor 302 may be an ultrasonic sensor, a gamma ray sensor, a resistivity sensor, etc. Measurement sensor 302 is configured to generate output data indicating the value of the desired parameter at each time step as the tool rotates and scans the sensor around the circumference of the wellbore. The output of measurement sensor 302 is provided to a processor 310 which stores the data in a memory 312.

In addition to measurement sensor 302, tool 100 includes a set of rotational sensors that includes, in this embodiment, a set of accelerometers 304, a gyroscope 306, and a magnetometer 308. Like measurement sensor 302, each of sensors 304, 306 and 308 generates a corresponding output value for each time step. Sensors 304, 306 and 308 are coupled to processor 310 which stores the data output by the sensors in memory 312. Thus, for the series of time steps, memory 312 stores values for: the measured parameter; the accelerometer outputs; gyroscope output; and the magnetometer output. It should be noted that it is not necessary to sample the different sensors at the same rate, and the measurements may be interpolated or otherwise processed as needed to enable the toolface corresponding to the wellbore measurements to be determined.

As noted above, the purpose of the system is to generate a two dimensional image or mapping of the measured parameter as a function of position around the wellbore. It is therefore necessary to determine, for each of the points to be imaged, the value of the measured parameter at the corresponding point and the position of the point. The measured parameter value is simply the output of the measurement sensor corresponding to the point. The position has an X component and a Y component. The Y component is simply the depth of the tool within the well. The X component of the position cannot be directly obtained from the outputs of the rotational sensors, but is instead derived from these outputs by processing them through a Kalman filter.

Figure 4:
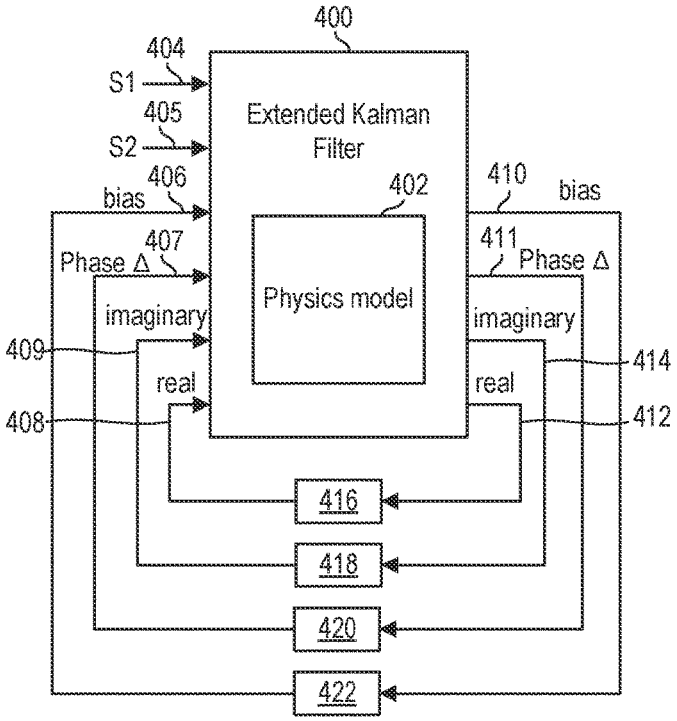
FIG. 4 is a diagram illustrating the states and inputs used by the Kalman filter in accordance with some embodiments.

The general operation of the Kalman filter is illustrated by the diagram of FIG. 4, which shows the states and inputs used by the Kalman filter in some embodiments. The Kalman filter generates a predicted toolface for a particular time step based on a physical model and a set of input states including the toolface for a preceding time step. As depicted in FIG. 4, Kalman filter 400 uses a physical model 402, which in this case is a constant velocity physics model (i.e., the model assumes that the tool is rotating with a constant rotational velocity through the timestep. This model is computationally simple and matches the observed behavior of the drillstring (which includes tool 100) to a reasonable degree.

Because tool 100 rotates within the wellbore, the X positions of the successive measurement points could present a discontinuity. in other words, with each rotation of the tool, the toolface increases continuously from 0 degrees to 360 degrees, and there is a discontinuity when the toolface goes from 360 back to 0 degrees. The toolface is therefore parameterized as a complex number so that it is represented as a pair of sinusoidally varying values—one real and one imaginary.

Kalman filter 400 is configured to use four states. Two of the states are the real and imaginary components of the toolface. These are provided to the Kalman filter at inputs 408 and 409. The other two states maintained by the Kalman filter are a bias and a phase difference which are provided to the Kalman filter at 406 and 407. The signals output by the accelerometers and the output of the gyroscope are provided to the Kalman filter at 404 and 405. Based on the four states, Kalman filter 400 generates a prediction of the real and imaginary components of the toolface for the next time step. The real component of the predicted toolface is provided as output 412, and the imaginary component is provided as output 414. The bias and phase difference for the next time step are output at 410 and 411. Each of these outputs is stored in a corresponding memory (e.g., register 416, 418, 420, 422), and these stored values are used as the real and imaginary toolface inputs (408, 410) and the bias and phase difference inputs 406, 407) to the Kalman filter for the next time step.

It should be noted that, in this embodiment, the output of magnetometer 308 is not used as a direct input to the Kalman filter. This is because, when the tool is used within a cased well, the magnetization of the casing can be significantly greater than the earth's magnetisation and can dominate this measurement. the magnetization of the casing can be irregular and can easily obscure the earth magnetization, rendering the sensor ineffective in terms of its ability to sense the toolface based on the earth's magnetization. However, because the magnetisation of the casing does not change dramatically with a small amount of axial movement of the tool, the output of the magnetometer is similar from one rotation of the tool to the next, so it is useful to determine when one full rotation of the tool is completed. The magnetometer output is therefore fed through a phase lock loop (PLL), which uses the zero-crossings of this signal timed to a revolution of the gyroscope to generate a sine wave that is matched in phase and frequency to the original magnetometer signal. In this manner, it is possible to extract cleaner magnetometer toolface data that is re-synced at each revolution of the tool.

Figure 5:
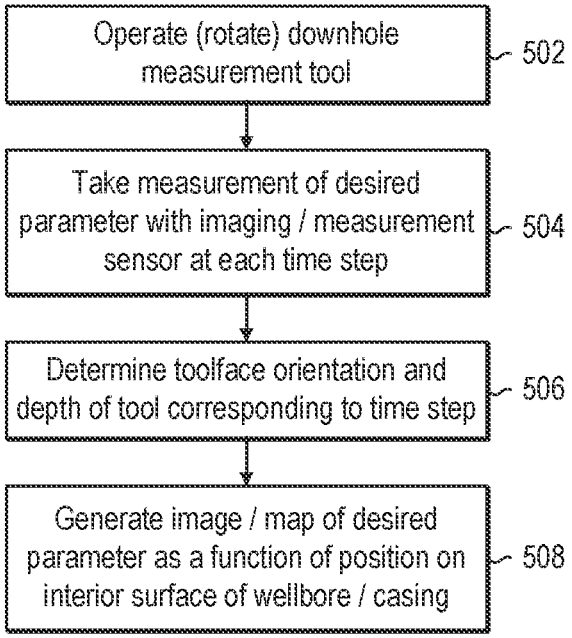
FIG. 5 is a flow diagram illustrating a method for generating an image or map from measured data as a function of axial and azimuthal position in a wellbore in accordance with some embodiments.

Referring to FIG. 5, a flow diagram is shown to illustrate a method for generating an image or map from measured data as a function of position around a wellbore in accordance with some embodiments. This figure represents a high level view of the process.

As depicted in the figure, a measurement tool which is connected to the lower end of a drill string is lowered into a well, and the drill string is rotated to cause the measurement tool to rotate (502). As the tool rotates, the sensor on the tool scans the wellbore, taking measurements of the desired parameter at each of a series of time steps (504). At the same time, the rotational sensors generate outputs corresponding to the position of the tool at the corresponding time steps. In the embodiment of FIG. 4, this includes generating outputs from the accelerometers, the gyroscope and the magnetometer.

The toolface and the depth of the tool are then determined for each of the time steps (506). The depth of the tool in the well is determined based on the length of the drill string which is lowered into the well. The toolface is determined from the outputs of the rotational sensors, as will be described in more detail below. Generally speaking, this involves using the magnetometer output to generate a phase locked loop, locking the gyroscope signal to this phase locked loop, and providing the locked output signal and the accelerometer signals to the Kalman filter. The Kalman filter predicts the toolface position using these signals and the toolface for the preceding time step. Then, using the resulting toolface position information and the measured parameter from the measurement sensor, an image or map of the parameter as a function of position on the interior of the wellbore is generated (508).

It should be noted that the generation of the toolface position information can be performed in various ways. In one embodiment, the outputs of each of the sensors (including the measurement sensor and the rotational sensors) are recorded by the tool, but are not processed by the Kalman filter while the tool is installed in the well. Instead, the recorded data is uploaded from the tool to a processing unit after it is removed from the well, and the processing unit (which implements the Kalman filter) computes the toolface position corresponding to each timestep. This information is then used to generate the image/mapping of the measured parameter as a function of position around the wellbore. The generation of the image/map may be performed by the same processing unit, or by a separate unit configured for this purpose. In an alternative embodiment, the processing unit may be incorporated into the tool itself, and the toolface position can be computed in real time as the filter inputs are received from the rotational sensors. The measured parameter and position information can then be uploaded from the tool to a processing unit that is configured to generate the image/mapping move that measured parameter.

Figure 6:
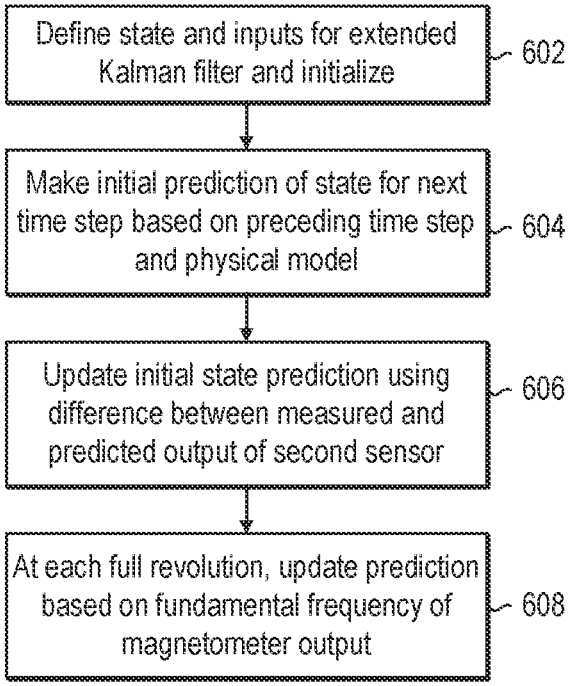
FIG. 6 is a flow diagram illustrating an overview of a method embodied in an extended Kalman filter for determining the toolface orientation from multiple rotational sensor measurements in accordance with some embodiments.

Referring to FIG. 6, a flow diagram illustrating an overview of a method embodied in a Kalman filter (in this case an extended Kalman filter) for determining the toolface from multiple rotational sensor measurements is shown. As depicted in this figure, a first step involves defining the state maintained by the extended Kalman filter (e.g., the real and imaginary components of the toolface), the inputs to the filter (e.g., the signal output by a gyroscope) and the physics model (e.g., constant velocity rotation) used by the filter (602). The extended Kalman filter is also initialized. In the next step, the extended Kalman filter predicts the state (the toolface) for the next time step based on the current state and the physics model embodied in the filter (604). For instance, using a constant rotational velocity model and assuming that the tool rotated at a corresponding constant speed for the full interval between the successive timesteps, the gyroscope measurement is integrated and the resulting angular change is added to the angular position at the preceding time step.

After the state prediction has been generated, the prediction is updated based on the signal from the accelerometers (606). The state prediction generated in the previous step is used to calculate a prediction for the accelerometer and the predicted accelerometer measurement is subtracted from the actual measurement to generate a state adjustment. Additionally in this embodiment, an update is generated based on the signal produced by the magnetometer (608). The magnetometer signal is not input directly to the extended Kalman filter, but is instead input to a phase locked loop which generates a sine wave that is locked in phase and frequency to the fundamental frequency of the magnetometer output. The update based on the phase locked loop output is performed once for each cycle of the phase locked signal has determined that a full tool revolution has occurred.

In one particular example, an extended Kalman filter uses measurements from rotational sensors that include a gyroscope, an accelerometer and a magnetometer. For the purposes of describing the execution of the extended Kalman filter, the following definitions are used:

| Variable | Definition |
|---|---|
| $\vec{y}$ | Measurement vector from sensors |
| $\vec{x}$ | State vector |
| $\vec{\tau}$ | Orientation vector, as complex number $\begin{bmatrix}\tau_1\\ \tau_2\end{bmatrix}, \vec{\tau} = \tau_1 + i\tau_2,\ \tau_1 = \cos\theta,\ \tau_2 = \sin\theta$ |
| R | Rotational translation matrix |
| $\alpha$ | Angle traveled during time step |
| T | Time step (in seconds) $\cdot \frac{1}{\text{Sample rate}}$ |
| $\delta$ | Bias |
| $\omega$ | Rotational speed |
| e | Noise |
| $\rho$ | Phase difference between mags and accel/tool coordinate system |
| t | Designates time step count (an integer) |
| $\vec{u}$ | Input vector |
| $\phi$ | Inclination from vertical |
| a | Designates accelerometer |
| m | Designates magnetometer |
| $\sigma$ | Standard deviation. Square to get variance |
| f | State transition matrix. Calculates estimated next states using inputs |

-continued

| Variable | Definition |
|---|---|
| F | Jacobian of state transition matrix $F_t = \left.\frac{\partial f_t(x_t, u_t, w_t)}{\partial x_t}\right\|_{\substack{w_t=0\\ x_t=\hat{x}_{t\|t}}}$ |
| Q | Process noise covariance matrix |
| G | Jacobian of uncertainties $G_t = \left.\frac{\partial f_t(x_t, u_t, w_t)}{\partial e}\right\|_{\substack{w_t=0\\ x_t=\hat{x}_{t\|t}}}$ |

In this example, the states to be tracked for each time step are defined. Four states are selected in this case, with orientation parameterized as a complex number in order to avoid the discontinuity in going from 360 degrees to 0 degrees. The state vector $\vec{x}$ at a time step t is defined as $$\vec{x}_t=(\vec{\tau}_t^{\,n}\delta_{\omega,t}\rho)^T$$

The orientation vector $\tau$ is $$\vec{\tau}_t = \begin{bmatrix}\tau_1\\ \tau_2\end{bmatrix}_t$$

The angular velocity from the gyroscope is selected as the sole input for this model:

$$u_t=y_{\omega,t}$$

$$y_{\omega,t}=\omega_{nb,t}^{\ b}+\delta_{\omega,t}^{\ b}+e_{\omega,t}^{\ b}$$

The sensor measurements of the accelerometer and magnetometer are defined for the model, which also includes an error term:

$$y_{a,t}=-R_t^{bn}g^n+e_{a,t}$$

$$y_{m,t}=R_t^{bn}m^n+e_{m,t}$$

When the inputs to the extended Kalman filter have been defined, the state vector is initialized. In this example, the initial orientation is taken strictly from accelerometers. The gyroscope bias and magnetometer offset are both initialized at 0:

$$\theta_0=\text{mod}(a\tan 2(a_y,a_x),2\pi)$$

$$\tau_{1,0}=\cos\theta_0$$

$$\tau_{2,0}=\sin\theta_0$$

$$\delta_{\omega,0}=0$$

$$\rho_0=0$$

$$x_0=[\tau_{1,0}\tau_{2,0}\delta_{\omega,0}\rho_0]^T$$

The State Covariance Matrix (P) is then initialized:

$$P_0=\sigma_0^2 I_4$$

The initial variances of each state may be selected based on experience.

The operation of the extended Kalman filter is iterative. Each iteration (in this case each time step) includes a first part that consists of a prediction based on the previous state and a second part that includes one or more updates to the prediction based on the signals that are input to the filter.

In the first part of each iteration, the state and covariance of the next timestep (t+1) is predicted using the state and covariance of the previous time (t) and the input (u). In the case of the rotating tool, the prediction of the toolface orientation is performed by integrating the gyroscope measurement and assuming that the tool rotated at a constant speed for the full timestep:

$$\vec{\tau}_{t+1} = R_{\alpha_t}\vec{\tau}_t$$

$$R_{\alpha_t} = \begin{bmatrix} \cos\alpha_t & -\sin\alpha_t \\ \sin\alpha_t & \cos\alpha_t \end{bmatrix}$$

$$\alpha_t = T\omega^b_{nb,t} = T(y_{\omega,t} - \delta_{\omega,t} - e_{\omega,t})$$

The gyroscope bias and magnetometer offset predictions for the next timestep use the assumption that they remained constant throughout the timestep (with some normally distributed error).

$$\delta_{\omega,t+1}=\delta_{\omega,t}+e_{\delta_\omega}$$

$$\rho_{t+1}=\rho_t+e_{\rho,t}$$

$$e_{\rho,t}\sim N(0,\sigma_{\rho,t}^2)$$

The extended Kalman filter then implements these predictions into matrix form, creating four functions (f1-f4) that calculate the predictions for the four state variables. This constructs the State Transition Matrix (f).

With $\alpha_t = T(y_{\omega,t} - \delta_\omega)$:

$$\hat{x}_{t+1|t} = f\hat{x}_{t|t}$$

$$\hat{x}_{t+1|t} = \begin{bmatrix} \cos\alpha & -\sin\alpha & 0 & 0 \\ \sin\alpha & \cos\alpha & 0 & 0 \\ 0 & 0 & 1 & 0 \\ 0 & 0 & 0 & 1 \end{bmatrix}\hat{x}_{t|t}$$

$$\begin{bmatrix} \hat{\tau}_1 \\ \hat{\tau}_2 \\ \hat{\delta}_\omega \\ \hat{\rho} \end{bmatrix}_{t+1|t} = \begin{bmatrix} \cos\alpha & -\sin\alpha & 0 & 0 \\ \sin\alpha & \cos\alpha & 0 & 0 \\ 0 & 0 & 1 & 0 \\ 0 & 0 & 0 & 1 \end{bmatrix}\begin{bmatrix} \hat{\tau}_1 \\ \hat{\tau}_2 \\ \hat{\delta}_\omega \\ \hat{\rho} \end{bmatrix}_{t|t}$$

$$\hat{\tau}_{1,t+1} = \hat{\tau}_{1,t}\cos\alpha - \hat{\tau}_{2,t}\sin\alpha = f_1$$

$$\hat{\tau}_{2,t+1} = \hat{\tau}_{1,t}\sin\alpha + \hat{\tau}_{2,t}\cos\alpha = f_2$$

$$\hat{\delta}_{\omega,t+1} = \hat{\delta}_{\omega,t} = f_3$$

$$\hat{\rho}_{t+1} = \hat{\rho}_t = f_4$$

The Jacobian of the State Transition Matrix (F) is then calculated for the extended Kalman filter. This is shown below, but the derivatives only need to be calculated once.

$$F_t = \left.\frac{\partial f_t(x_t, u_t, w_t)}{\partial x_t}\right|_{\substack{w_t=0 \\ x_t=\hat{x}_{t|t}}}$$

$$F_t = \begin{bmatrix} \cos\alpha & -\sin\alpha & T\hat{\tau}_1\sin\alpha + T\hat{\tau}_2\cos\alpha & 0 \\ \sin\alpha & \cos\alpha & -T\hat{\tau}_1\cos\alpha + T\hat{\tau}_2\sin\alpha & 0 \\ 0 & 0 & 1 & 0 \\ 0 & 0 & 0 & 1 \end{bmatrix}$$

Q is the Process Noise Covariance Matrix, which has a variance corresponding to each assumed process noise. These are selected from experience.

$$Q = \begin{bmatrix} \sigma_\omega^2 & 0 & 0 & 0 \\ 0 & \sigma_\omega^2 & 0 & 0 \\ 0 & 0 & \sigma_{\delta_\omega}^2 & 0 \\ 0 & 0 & 0 & \sigma_\rho^2 \end{bmatrix}$$

The Jacobian of the uncertainty (G) is calculated due to the process noise. As above, the derivatives are calculated once.

$$G_t = \left.\frac{\partial f_t(x_t, u_t, w_t)}{\partial e}\right|_{\substack{w_t=0 \\ x_t=\hat{x}_{t|t}}}$$

$$G_t = \begin{bmatrix} T\hat{\tau}_{1,t}\sin\alpha + T\hat{\tau}_{2,t}\cos\alpha & T\hat{\tau}_{1,t}\sin\alpha + T\hat{\tau}_{2,t}\cos\alpha & 0 & 0 \\ -T\hat{\tau}_{1,t}\cos\alpha + T\hat{\tau}_{2,t}\sin\alpha & -T\hat{\tau}_{1,t}\cos\alpha + T\hat{\tau}_{2,t}\sin\alpha & 0 & 0 \\ 0 & 0 & 1 & 0 \\ 0 & 0 & 0 & 1 \end{bmatrix}$$

Using the equations for F, G, and Q, along with the State Covariance Matrix from the previous timestep, the prediction of the State Covariance for the next time step is calculated:

$$P_{t+1|t}=F_tP_{t|t}F_t^T+G_tQG_t^T$$

In the second part of the iteration for each time step, the prediction of the extended Kalman filter is updated. In this example, updates using the measurements taken from the accelerometers and magnetometers are performed asynchronously. This means that there are two different update operations that can be applied independently. In this embodiment, the update from the accelerometers is performed at each timestep.

The state estimates generated in the previous step are used to calculate a prediction for what the measurement will be. The Measurement Transition Matrix (h) is formulated here for that purpose.

$$y_{a,t} = \begin{bmatrix} y_{ax} \\ y_{ay} \end{bmatrix}_t$$

$$y_t = \begin{bmatrix} y_{ax} \\ y_{ay} \end{bmatrix}_t$$

$$y_{a,t} = -R_t^{bn}g^n + e_{a,t}$$

$$\hat{y}_{a,t+1|t} = -\hat{R}^{bn}_{t|t-1}g^n$$

$$\hat{y}_{a,t+1|t} = \begin{bmatrix} \hat{\tau}_1 \\ \hat{\tau}_2 \end{bmatrix}_{t|t-1}$$

$$\hat{y}_{t+1|t} = h_t(\hat{x}_{t+1|t})$$

$$\hat{y}_{t+1|t} = \begin{bmatrix} \hat{\tau}_1 \\ \hat{\tau}_2 \end{bmatrix}_{t|t-1}$$

In preparation for the next steps, the accelerometer measurements in this embodiment are normalized to help reduce error from inertial accelerations.

$$\bar{y}_{a,t+1} = \frac{y_{a,t+1}}{\|y_{a,t+1}\|}$$

Here, the predicted measurements are subtracted from the actual measurements to form the innovation:

$$\epsilon_{t+1}=y_{t+1}-\hat{y}_{t+1|t}$$

The Jacobian of the Measurement Transition Matrix (H) is calculated below. As before, this is a one-time operation, with the final equation being implemented in code.

$$H_{t+1} = \frac{\partial h_t(x_t)}{\partial x_t}\Big|_{x_t=\hat{x}_{t|t-1}}$$

$$H_{t+1} = \begin{bmatrix} 1 & 0 & 0 & 0 \\ 0 & 1 & 0 & 0 \end{bmatrix}$$

The Measurement Noise Covariance matrix (R) is assembled using the variances from the accelerometer readings. This is selected from experience.

$$R = \begin{bmatrix} \sigma_a^2 & 0 \\ 0 & \sigma_a^2 \end{bmatrix}$$

The matrices above are to calculate the Kalman Gain (K), which will scale the influence on the next state update. These are standard EKF operations.

$$S_{t+1}=H_{t+1}P_{t+1|t}H_{t+1}^T+R$$

$$K_{t+1}=P_{t+1|t}H_{t+1}^T S_{t+1}^{-1}$$

The updated state vector and State Covariance Matrix are then calculated. These will be used as the inputs into the next prediction iteration.

$$\tilde{x}_{t+1|t+1}=\hat{x}_{t+1|t}+K_{t+1}\epsilon_{t+1}$$

$$\tilde{P}_{t+1|t+1}=P_{t+1|t}-K_{t+1}S_{t+1}K_{t+1}^T$$

Tau is then normalized:

$$\hat{\tau}_{t+1|t+1} = \frac{\tilde{\tau}_{t+1|t+1}}{\|\hat{\tau}_{t+1|t+1}\|_2}$$

The same process that is used to update the estimates from the accelerometers is used for the magnetometers. The magnetometer measurement, however, isn't taken directly from the sensor—instead, it is first fed through a phase locked loop (PLL) to generate a smooth sine wave that is locked in phase and frequency to the fundamental frequency of the magnetometer sensor reading.

This update process is performed each time that the phase-locked signal has determined that a full tool revolution has occurred:

$$y_{m,t}=y_{mx}$$

$$y_t=y_{mx}$$

Since this will be updated every time the magnetometer algorithm detects that a revolution has occurred, its estimation is that theta=0, plus whatever phase offset there is:

$$\hat{y}_{m,t+1|t} = \hat{\rho}$$

$$\hat{y}_{t+1|t} = h_t(\hat{x}_{t+1|t})$$

$$\hat{y}_{t+1|t} = [\hat{\rho}]_{t|t-1}$$

$$\epsilon_{t+1} = y_{t+1} - \hat{y}_{t+1|t}$$

-continued $$H_{t+1} = \frac{\partial h_t(x_t)}{\partial x_t}\Big|_{x_t=\hat{x}_{t|t-1}}$$

$$H_{t+1} = [0\ 0\ 0\ 1]$$

$$R = [\sigma_m^2]$$

$$\hat{y}_{t+1|t} = h(\hat{x}_{t+1|t})$$

The updated parameters are then calculated:

$$S_{t+1}=H_{t+1}P_{t+1|t}H_{t+1}^T+R$$

$$K_{t+1}=P_{t+1|t}H_{t+1}^T S_{t+1}^{-1}$$

$$\tilde{x}_{t+1|t+1}=\hat{x}_{t+1|t}+K_{t+1}\epsilon_{t+1}$$

$$\tilde{P}_{t+1|t+1}=P_{t+1|t}-K_{t+1}S_{t+1}K_{t+1}^T$$

Tau is then normalized:

$$\hat{\tau}_{t+1|t+1} = \frac{\tilde{\tau}_{t+1|t+1}}{\|\hat{\tau}_{t+1|t+1}\|_2}$$

The foregoing description provides one example of a system that uses multiple different types of sensors (e.g., gyroscopes, accelerometers, magnetometers) in combination to generate position information that indicates the orientation of the toolface of a rotating tool (e.g., a tool that is coupled to the end of a rotating drill pipe. It should be noted that alternative embodiments of the invention may have variations of the specific details described above without departing from the scope of the invention. For example, the measurement sensor may include sensors to obtain various different types of parameters, such as ultrasound sensors, optical sensors, gamma ray sensors, etc. Similarly, the rotational sensors can include different types or different numbers of sensors than described above. The specific rotational sensors in the embodiments described above include gyroscopes, accelerometers and magnetometers because these are the three types of sensors that are sometimes used individually in conventional measurement systems. In some embodiments, the extended Kalman filter may use inputs received directly from the rotational sensors, while in others, some signals (e.g., magnetometers in cased wells) may be preprocessed by PLL or other processing before being input to the extended Kalman filter.

The various embodiments of the invention may provide a number of advantages over existing systems and methods. For instance, because the orientation of the toolface can be accurately determined from the multiple rotational sensors, the entire tool can be rotated instead of using a tool that is designed for use with a wireline, where part of the tool remains stationary while another part rotates (and the rotational position is determined from an encoder within the tool). Since the tools in the present embodiments do not need to have both stationary and rotating components and a position encoder, they are more simple and less expensive. Additionally, since the present tools are coupled to the end of a drill pipe, the depth of the tool can be more accurately determined, as the wireline is more flexible and elastic so the length of the wireline to the tool may be somewhat variable. The present embodiments also have advantages over similar tools that are rotated at the end of a drill pipe, as existing systems normally use only a single rotational sensor, and any single one of these sensors has its own disadvantages (e.g., gyroscope derived position drifts, accelerometers do not work for toolface in vertical wells, magnetometers are not effective in cased wells). It should be noted that the embodiments disclosed herein may be used in both cased, partially cased and uncased wells. Still other advantages may be apparent to those skilled in the art.

The benefits and advantages which may be provided by the present invention have been described above with regard to specific embodiments. These benefits and advantages, and any elements or limitations that may cause them to occur or to become more pronounced are not to be construed as critical, required, or essential features of any or all of the described embodiments. As used herein, the terms "comprises," "comprising," or any other variations thereof, are intended to be interpreted as non-exclusively including the elements or limitations which follow those terms. Accordingly, a system, method, or other embodiment that comprises a set of elements is not limited to only those elements, and may include other elements not expressly listed or inherent to the described embodiment.

While the present invention has been described with reference to particular embodiments, it should be understood that the embodiments are illustrative and that the scope of the invention is not limited to these embodiments. Many variations, modifications, additions and improvements to the embodiments described above are possible. It is contemplated that these variations, modifications, additions and improvements fall within the scope of the invention as detailed by the claims of the application.

What is claimed is:

1. A method comprising:

providing a measurement tool having a measurement sensor to measure a desired well parameter in a direction of a toolface of the measurement tool and a plurality of rotational sensors adapted to measure corresponding parameters that are dependent upon a rotational orientation of the measurement tool, the plurality of rotational sensors including a magnetometer that measures a casing magnetization of a cased wellbore;

positioning the measurement tool in the cased wellbore;

rotating the measurement tool in the cased wellbore;

measuring the casing magnetization of the cased wellbore with the magnetometer;

providing the measured casing magnetization output by the magnetometer to a phase locked loop circuit that generates a sine wave which is synchronized with the casing magnetization output by the magnetometer;

for each of a series of time steps while the measurement tool is rotating in the wellbore, measuring the desired well parameter with the measurement sensor;

measuring the parameters corresponding to the plurality of rotational sensors;

periodically synchronizing measurements of the parameters corresponding to the plurality of rotational sensors to the sine wave generated by the phase locked loop circuit;

providing the measurements of the parameters corresponding to the plurality of rotational sensors to a Kalman filter, the Kalman filter generating a prediction of a current toolface based on a preceding toolface and the measurements of the parameters corresponding to the plurality of rotational sensors; and generating data that maps the desired well parameter, the data including for each of the series of time steps, the corresponding measurement of the desired well parameter and the corresponding predicted toolface.

2. The method of claim 1, further comprising, for each of the series of time steps, measuring a depth of the measurement tool in the wellbore.

3. The method of claim 2, further comprising generating an image of the desired well parameter as a function of position in the wellbore, the position comprising the depth of the measurement tool in the wellbore and the toolface.

4. The method of claim 1, wherein the measurement tool is coupled to a drill pipe and wherein rotating the measurement tool in the wellbore comprises rotating the drill pipe.

5. The method of claim 1, wherein the plurality of rotational sensors comprise a gyroscope and a set of accelerometers, and wherein measuring the parameters corresponding to the plurality of rotational sensors comprises measuring an angular velocity of the gyroscope and measuring an acceleration using the set of accelerometers.

6. The method of claim 5, wherein the Kalman filter generating the prediction of the current toolface comprises: generating an initial prediction based on the time step and a physical model for a change in the toolface between time steps; performing a first update of the initial prediction based on a corresponding measurement from a first rotational sensor of the plurality of rotational sensors to generate an intermediate prediction; and performing a second update of the intermediate prediction based on a corresponding measurement from a second rotational sensor of the plurality of rotational sensors to generate a final prediction.

7. The method of claim 6, wherein the first rotational sensor comprises the gyroscope and the second rotational sensor comprises the set of accelerometers.

8. A system comprising:

a downhole measurement tool having a coupling adapted to connect the downhole measurement tool to a drill pipe;

a measurement sensor adapted to measure a desired well parameter radially outward from the downhole measurement tool in a direction of a toolface of the downhole measurement tool;

two or more rotational sensors adapted to measure corresponding parameters that are dependent upon a rotational orientation of the downhole measurement tool, the plurality of rotational sensors including a magnetometer that measures a casing magnetization of a cased wellbore and outputs the measured casing magnetization of the cased wellbore, wherein the measured casing magnetization output is provided by the magnetometer to a phase locked loop circuit that generates a sine wave which is synchronized with the casing magnetization output by the magnetometer, and wherein measurements of the parameters corresponding to the plurality of rotational sensors are periodically synchronized to the sine wave generated by the phase locked loop circuit; and a hardware processor which implements a Kalman filter, the Kalman filter receiving as inputs signals from the two or more rotational sensors;

wherein the downhole measurement tool is adapted to be rotated within the cased wellbore;

wherein for each of a series of time steps, the downhole measurement tool rotates a corresponding amount, the measurement sensor makes a corresponding measurement, and the Kalman filter predicts a current toolface based on the preceding toolface and the signals input from the two or more rotational sensors.

9. The system of claim 8, wherein the hardware processor further implements an imaging application which is adapted to map, for each time step, the corresponding measurement of the desired well parameter as a function of the corresponding predicted toolface.

10. The system of claim 8, wherein the two or more rotational sensors comprise a gyroscope and a set of accelerometers.

11. The system of claim 10, wherein the Kalman filter is adapted to generate each toolface prediction by: generating an initial prediction based on the time step and a physics model for a change in the toolface between time steps; performing a first update to an initial prediction based on a corresponding measurement from a first rotational sensor of the two or more rotational sensors to generate an intermediate prediction; and performing a second update of the intermediate prediction based on a corresponding measurement from a second rotational sensor of the two or more rotational sensors to generate a final prediction.

12. The system of claim 11, wherein the first rotational sensor comprises the gyroscope and the second rotational sensor comprises the set of accelerometers.

13. A system comprising:

a downhole measurement tool having a coupling adapted to connect the downhole measurement tool to a drill pipe;

a measurement sensor adapted to measure a desired well parameter radially outward from the downhole measurement tool in a direction of a toolface of the downhole measurement tool;

two or more rotational sensors adapted to measure corresponding parameters that are dependent upon a rotational orientation of the downhole measurement tool, the plurality of rotational sensors including a magnetometer that measures a casing magnetization of a cased wellbore and outputs the measured casing magnetization of the cased wellbore; and a memory coupled to receive measurements from the measurement sensor and the two or more rotational sensors;

wherein the downhole measurement tool is adapted to be rotated within the cased wellbore;

wherein the measured casing magnetization output is provided by the magnetometer to a phase locked loop circuit that generates a sine wave which is synchronized with the casing magnetization output by the magnetometer;

wherein measurements of the parameters corresponding to the plurality of rotational sensors are periodically synchronized to the sine wave generated by the phase locked loop circuit;

wherein for each of a series of time steps, the downhole measurement tool rotates a corresponding amount, the measurement sensor makes a corresponding measurement, two or more rotational sensors make corresponding measurements, and the measurements from the measurement sensor and the two or more rotational sensors, are stored in the memory; and a hardware processor which implements a Kalman filter, the Kalman filter adapted to receive as inputs the stored measurements from the two or more rotational sensors, and predict, for each time step in the series of time steps, a corresponding toolface based on a preceding toolface and the measurements for the time step from the two or more rotational sensors.

* * * * *